United States Patent [19]

Gabriel et al.

[11] Patent Number: 4,670,923

[45] Date of Patent: Jun. 9, 1987

[54] TRANSPARENT CRIB BUMPER PADS

[76] Inventors: Janice Y. Gabriel, 19 Temple Ct., Brooklyn, N.Y. 11218; George Spector, 233 Broadway RM 3615, New York, N.Y. 10007

[21] Appl. No.: 840,212

[22] Filed: Mar. 17, 1986

[51] Int. Cl.[4] ..... A47C 27/08

[52] U.S. Cl. ..... 5/424; 5/100; 5/455

[58] Field of Search ..... 5/93 R, 100, 280, 425, 5/426, 449, 453, 455, 424

[56] References Cited

U.S. PATENT DOCUMENTS

| | | | |
|---|---|---|---|
| 2,128,978 | 9/1938 | Akin | 5/93 R |
| 2,687,537 | 8/1954 | Wallace et al. | 5/280 |
| 3,018,492 | 1/1962 | Rosen | 5/455 |
| 3,137,870 | 6/1964 | Fink | 5/93 R |
| 3,321,779 | 5/1967 | Kaufman et al. | 5/93 R |
| 3,323,147 | 6/1967 | Van Dean | 5/98 |
| 3,803,646 | 4/1974 | Newerowski | 5/93 R |
| 3,931,652 | 1/1976 | Navarra | 4/177 |
| 4,003,098 | 1/1977 | Fink | 5/93 R |
| 4,104,750 | 8/1978 | Kelter et al. | 5/93 R |

*Primary Examiner*—Gary L. Smith
*Assistant Examiner*—Michael F. Trettel

[57] ABSTRACT

A crib bumper pad which is inflatable and fabricated out of transparent material so that a baby can be completely observed at all times within a crib. In a modified form a mattress is integral with the bumper pad and the complete unit is inflated by a foot pump.

2 Claims, 4 Drawing Figures

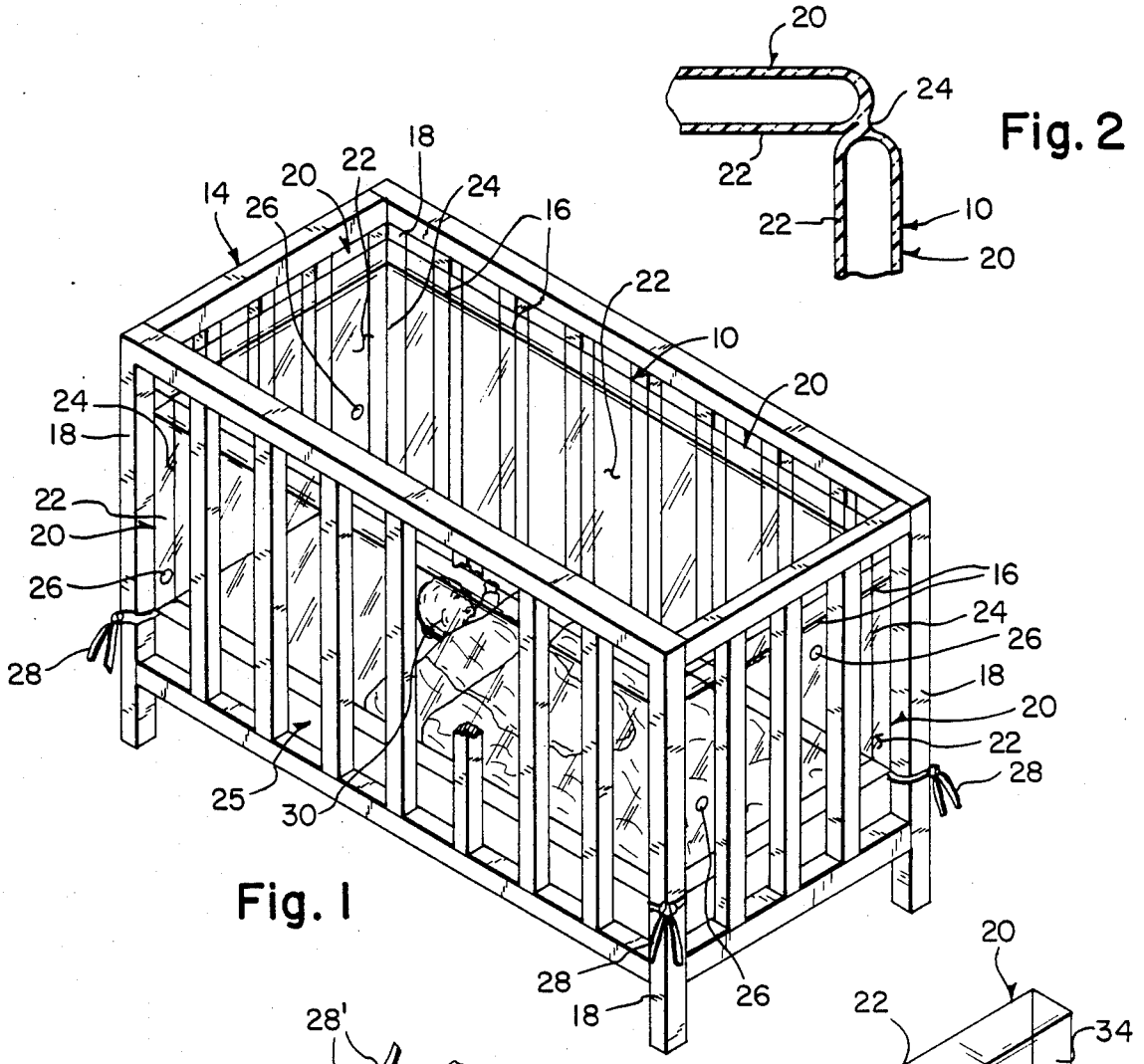
Fig. 1
Fig. 2
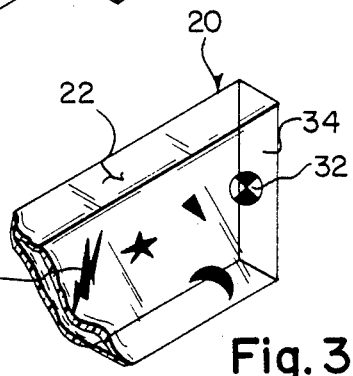
Fig. 3
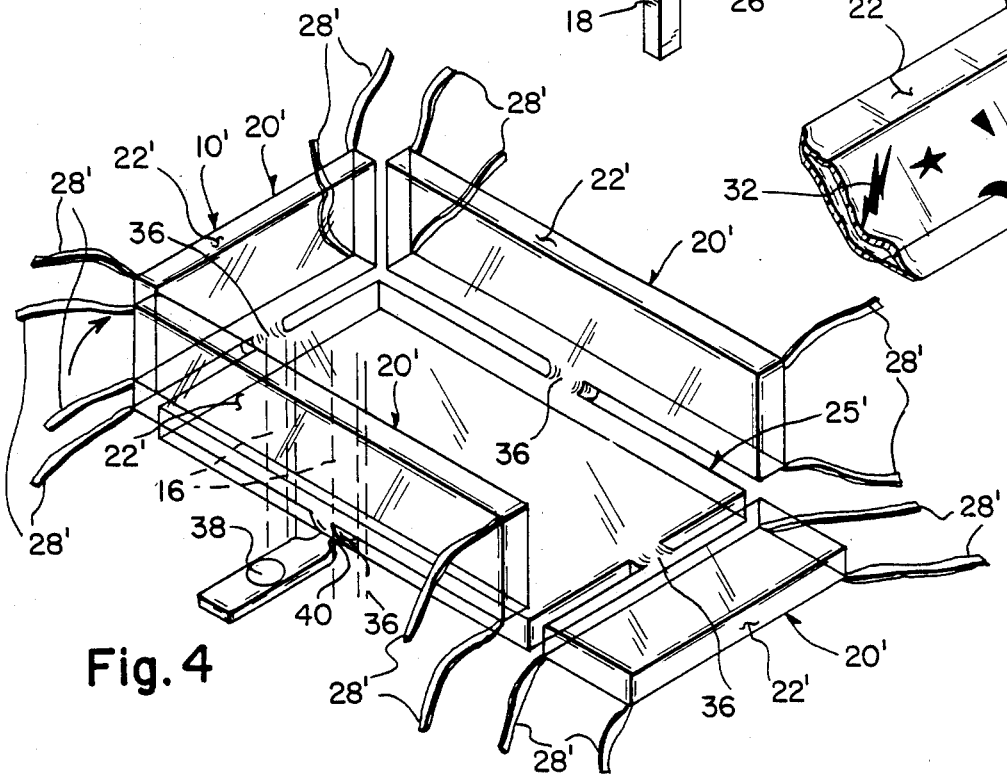
Fig. 4

TRANSPARENT CRIB BUMPER PADS

BACKGROUND OF THE INVENTION

The instant invention relates generally to baby cribs and more specifically it relates to a crib bumper pad.

Numerous baby cribs have been provided in prior art that adapted to include inflatable structures to protect the babies. For example, U.S. Pat. No. 3,018,492; 3,763,506 and 4,003,098 all are illustrative of such prior art. While these units may be suitable for the particular purpose to which they address, they would not, be as suitable for the purposes of the present invention as heretofore described.

SUMMARY OF THE INVENTION

A primary object of the present invention is to provide a crib bumper pad that will overcome the shortcomings of the prior art devices.

Another object is to provide a crib bumper pad that is inflatable and fabricated out of transparent material so that the baby can be completely observed at all times within a crib.

An additional object is to provide a crib bumper pad in which the mattress is integral with the bumper pad and the complete unit can be inflated by a foot pump.

A further object is to provide a crib bumper pad that is simple and easy to use.

A still further object is to provide a crib bumper pad that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of a baby in a crib with the invention applied thereto.

FIG. 2 is an enlarged cross sectional view taken at one corner of the bumper pad showing the inflatable features within.

FIG. 3 is a partial perspective view of a modified form having a design printed on inwardly facing wall of the bumper pad.

FIG. 4 is a perspective view of another modified form wherein the mattress is integral with the bumper pad and the complete unit is inflatable by a foot pump attached thereto.

DETAILED DESCRIPTION OF THE PREFERRED EMBODIMENTS

Turning now descriptively to the drawings, in which similar reference characters denote similar elements throughout the several views, FIGS. 1 and 2 illustrate a crib bumper pad 10 for a crib 14 or the like that has a plurality of upstanding slats 16 and upstanding support posts 18. The pad 10 consists of four elongated inflatable sections 20. Each of the sections is formed of fluid impervious transparent plastic material 22. Each of the inflatable sections 20 is mutually interconnected together at 24. Adjacent ones of the four mutually interconnected sections 20 is angular positionable relative to each other to assume a protective conforming configuration and position within the crib 14 on a mattress 25 and along the upstanding slats 16 thereof.

Air valves 26 are operatively interconnected with the pad 10 for inflating and deflating each of the sections 20. Ties 28 on the pad 10 are for securing the pad to the upstanding support posts 18 of the crib 14. A baby 30 within the crib can be safely observed at all times through the transparent plastic material 22 of the sections 20. The baby 30 can see out of the crib 14 through the transparent plastic material 22 of the sections 20 to surrounding environment.

As shown in FIG. 3 each of the sections 20 could have a plurality of indicia 32 printed on inwardly facing wall 34 thereof. The baby 30 can see close up the indicia 32 along with depth perception into the surrounding environment between the indicia 32. The indicia can include various small geometric shapes spaced randomly apart so as not to obstruct easy viewing and whereby the baby 30 can be visually stimulated by the shapes.

FIG. 4 shows a modified crib bumper pad 10' that includes an inflatable mattress 25' which has four elongated inflatable sections 20'. Each of the sections is fluidly connected by a conduit 36 to the mattress 25' and formed of fluid impervious transparent plastic material 22'. The sections 20' assume a protective conforming configuration along the upstanding slats 16 thereof when the mattress 25' is placed within the crib 14.

A foot pump 38 with a one way check valve 40 is operatively interconnected with the mattress 25' for inflating and deflating the mattress and the sectons 20'. Ties 28' on the sections 20' are for securing the sections to the upstanding support posts 18 of the crib 14. A baby 30 within the crib can be safely observed at all times through the transparent plastic material 22' of the sections 20'. The baby 30 can see out of the crib 14 through the transparent plastic material 22' of the sections 20' to surrounding environment.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A crib bumper pad adapted for a crib or the like having a plurality of upstanding slats and upstanding support posts, said pad comprising:

(a) an inflatable mattress with spaced connections to the mid-points of spaced inflatable sections, each of said connections being a flexible conduit of fluid impervious transparent material whereby said conduit is of lesser width than said section and mattress thus providing spaces between said sections and mattress, said sections being pivotable about said conduit to upstanding positions to assume a protective conforming configuration along said upstanding slats therof when said mattress is placed within said crib;

(b) means operatively connected with said mattress extending outwardly thereof for inflating and deflating said mattress and said sections externally of the crib; and (c) means on said sections for securing said sections to said upstanding support posts of said crib so that a baby within said crib can be safely observed at all times through said transparent material sections and said baby can see out of said crib through said transparent material sections to surrounding environment.

2. A crib bumper pad as in claim 1, wherein each said conduit integrally joins the mattress and a corresponding adjacent section centrally thus providing means for pivoting each section upwardly and means for fluid intercommunication between said sections and mattress.

* * * * *